US006253746B1

(12) United States Patent
Warren

(10) Patent No.: US 6,253,746 B1
(45) Date of Patent: Jul. 3, 2001

(54) REGENERATOR PROTECTOR

(76) Inventor: Edward Lawrence Warren, 3912 Snowy Egret Dr., West Melbourne, FL (US) 32904

( * ) Notice: Subject to any disclaimer, the term of this patent is extended or adjusted under 35 U.S.C. 154(b) by 0 days.

(21) Appl. No.: 09/658,927

(22) Filed: Sep. 11, 2000

(51) Int. Cl.[7] ..... F02G 5/00
(52) U.S. Cl. ..... 123/543
(58) Field of Search ..... 123/543, 546, 123/552, 550, 25 C, 556; 60/517

(56) References Cited

U.S. PATENT DOCUMENTS 4,284,055 * 8/1981 Wakeman ..... 123/556
4,790,284 12/1988 Ferrenberg et al. ..... 123/543
4,928,658 5/1990 Ferrenberg et al. ..... 123/543
5,540,191 * 7/1996 Clarke ..... 123/25 C
6,116,222 * 9/2000 Warren ..... 123/543

* cited by examiner

*Primary Examiner*—Marguerite McMahon

(57) ABSTRACT

This invention is protector 24 attached to movable regenerator 10 used in a two stroke regenerative, reciprocating, internal combustion engine employing a plunger piston 11 housing movable regenerator 10. The protector 24 has protector valve 26 to allow fluid to flow through protector 24 whenever movable regenerator 10 is away from cylinder head 4. Attached between plunger piston 11 and protector valve 26 is protector valve spring 27 to urge protector valve open whenever movable regenerator 10 is away from cylinder head 4. The advantages of protector 24 are: The regenerator 10 is protected from the combustion heat, and the regenerator fluid volume does not effect the thermal pressure rise process of the engine.

2 Claims, 2 Drawing Sheets

REGENERATOR PROTECTOR

BACKGROUND

1. Field of Invention

Figure 1:
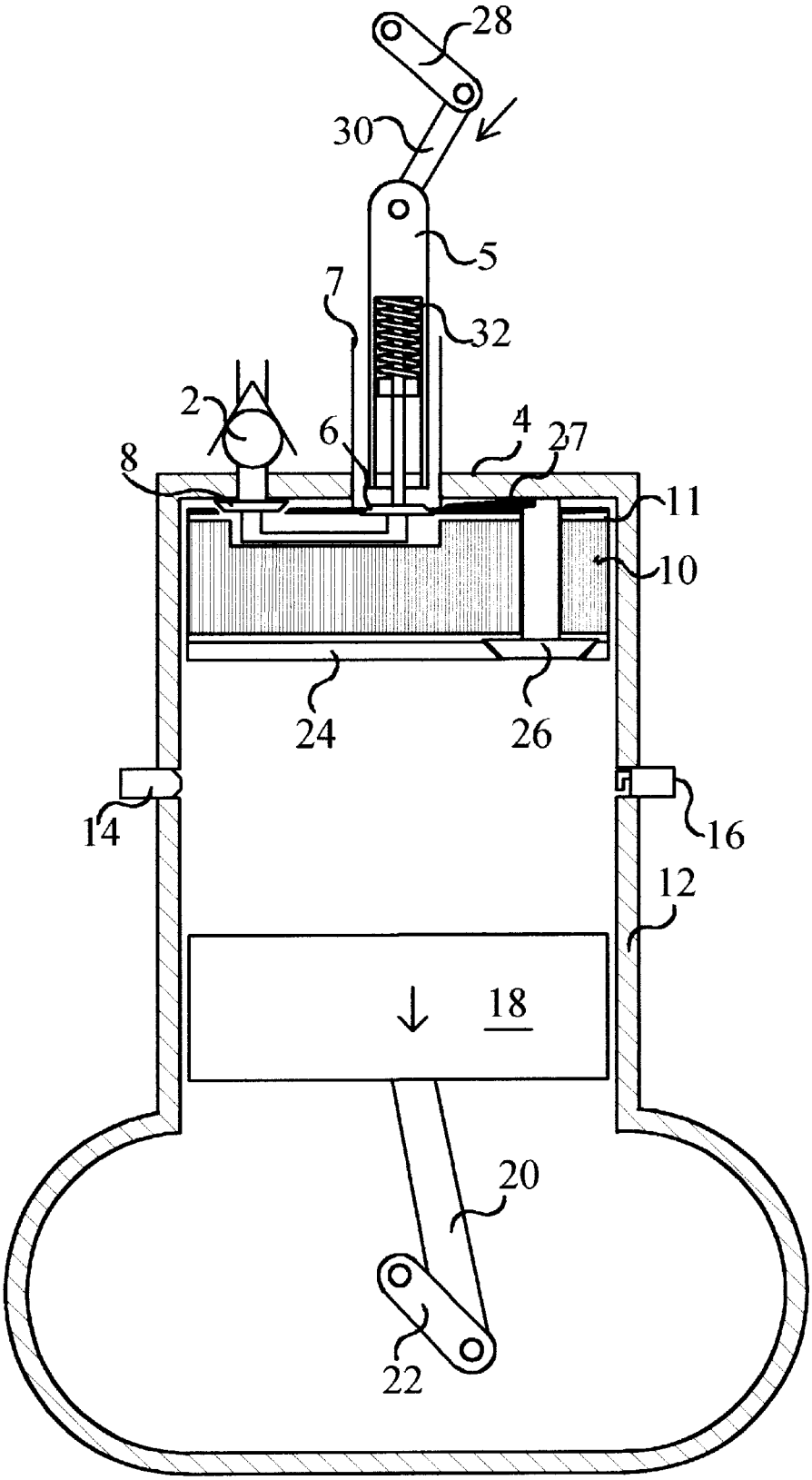

The present invention relates to thermally regenerated, reciprocating internal combustion engines that store the exhaust heat and return it to the engine cycle to do work.

2. Description of Prior Art

Thermal regeneration is the capturing of waste heat from a thermodynamic cycle (or a heat engine operating on some thermodynamic cycle), and the utilization of that energy within the cycle or engine to improve the cycle or engine's performance. This is commonly done with many heat engines including Stirling engines, gas turbines, and Rankine cycle devices. In a gas turbine the exhaust heat coming out of the exhaust is transferred to the air leaving the compressor and going into the combustor. This way it is not necessary to add as much heat (fuel) in the combustor to raise the air temperature to the desired turbine inlet temperature. This means that the same work is accomplished but less fuel is used. The automobile and trick gas turbines use rotating regenerators to transfer energy from the exhaust gases to the compressed air.

The problem encountered in previous regenerators in reciprocating internal combustion engines is: the temperature from the combustion process destroys the regenerator unless the temperature is kept low or the regenerator is cooled. Another problem is: the fluid volume of the regenerator enters into the cycle performance.

SUMMARY

This invention is used in a two stroke, internal combustion, reciprocating, regenerated engine made up of a number of similar working emits. Each working unit is comprised of a cylinder that is closed at one end by a cylinder head and contains a movable power piston that is connected to a power output shaft. Means are provided (a plunger piston) to suck in the working fluid and push the exhaust out of the cylinder. This plunger piston can move between the power piston and the cylinder head, and means are provided to accomplish this movement at the appropriate times during the engine's operating cycle. The plunger piston is a movable wall that has attached to it a plunger piston valve that opens to allow air to flow through the movable wall while the plunger piston is moving away from the power piston, and closes to form a suction plunger while the plunger piston is moving towards the power piston. The plunger piston also has attached to it an exhaust pipe, an exhaust valve that opens while the plunger piston is moving towards the power piston, and an alternating flow heat exchanger, called a regenerator. The movement of the plunger piston with its regenerator is such that the regenerative exhaust cooling stroke (the regenerator is heating) begins when the power piston is at about 85% of the expansion stroke, and ends when the power piston is about 15% of the way towards the cylinder head. The compressed air heating stroke (the regenerator is giving up heat) begins about 85% toward top dead center (315°) of the power piston's compression stroke, and ends at about top dead center. Means are provided for the introduction of fuel into the cylinder.

This invention is: the addition of a protector between the regenerator and the power piston to protect the regenerator from the heat of combustion, and to prevent the regenerator fluid volume from effecting the thermal pressure rise process of the engine. This protector has a valve in it to allow fluid flow through the protector whenever the plunger piston is away from the cylinder head.

Objects and Advantages

The objects and advantages of the regenerator protector are:

(a) The regenerator is protected from the combustion heat.

(b) The regenerator fluid volume does not effect the thermal pressure rise process of the engine.

DRAWING FIGURES

FIG. 1 is a schematic illustration of a two stroke regenerative engine with movable regenerator 10 protected by protector 24 prior to the start of the inlet and exhaust part of the cycle. Protector valve 26 is open.

Figure 2:
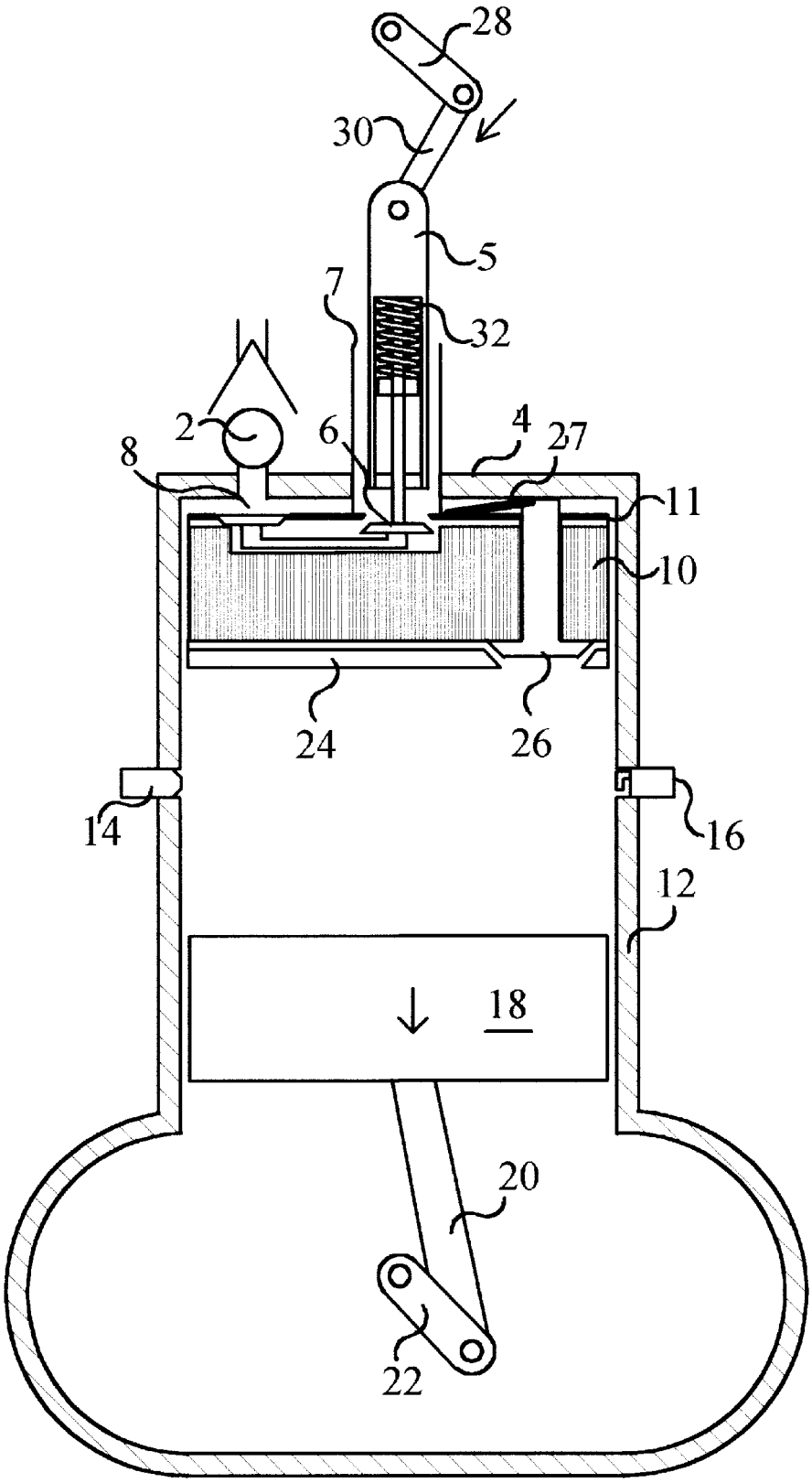

FIG. 2 is a schematic illustration of a two stroke regenerative engine with movable regenerator 10 protected by protector 24 after the start of the inlet and exhaust part of the cycle. Protector valve 26 is closed.

| Reference Numerals in Drawings | |
|---|---|
| 2 | air inlet valve |
| 4 | cylinder head |
| 5 | actuator |
| 6 | exhaust valve |
| 7 | exhaust pipe |
| 8 | plunger piston valve |
| 10 | movable regenerator |
| 11 | plunger piston |
| 12 | cylinder |
| 14 | fuel injector |
| 16 | integer |
| 18 | power piston |
| 20 | connecting rod |
| 22 | power output shaft |
| 24 | protector |
| 26 | protector valve |
| 27 | protector valve spring |
| 28 | upper crankshaft |
| 30 | upper connecting rod |
| 32 | spring |

DESCRIPTION—FIGS. 1 to 2

Preferred Embodiment

This invention is protector 24 attached to movable regenerator 10 used in a two stroke regenerative, reciprocating, internal combustion engine employing a plunger piston 11 housing movable regenerator 10 as described herein. The protector 24 has protector valve 26 to allow fluid to flow through protector 24 whenever movable regenerator 10 is away from cylinder head 4. Attached between plunger piston 11 and protector valve 26 is protector valve spring 27 to urge protector valve 26 open whenever movable regenerator 10 is away from cylinder head 4.

FIG. 1 shows plunger piston 11 containing movable regenerator 10 up against cylinder head 4. Protector valve 26 is closed.

FIG. 2 shows plunger piston 11 containing movable regenerator 10 away from cylinder head 4. Protector valve 26 is open.

The engine shown using regenerator protector 24 is a two stroke engine with plunger piston 11; however it could also be used in a four stroke engine with a moveable regenerator.

The two stroke engine has cylinder 12 which is closed at one end by a cylinder head 4 that contains air inlet valve 2. When air inlet valve 2 is open it allows air to be sucked into the cylinder volume located between cylinder head 4 and plunger piston 11. Cylinder 12 further contains fuel injector 14; power piston 18 which is connected to power output shaft 22 by a connecting rod 20 (for converting the linear motion of the piston to the rotating motion of the shaft); and igniter 16. The expanding gases exert a force on power piston 18, (a cylindrical piston that can move up and down in cylinder 12). That force, exerted on power piston 18 moving it down, is transmitted via connecting rod 20 and power output shaft 22 to a load (not shown). Cylindrically shaped plunger piston 11 houses cylindrically shaped movable regenerator 10, exhaust valve 6, plunger piston valve 8, protector 24, protector valve 26, protector valve spring 27, and exhaust pipe 7. Exhaust valve 6 allows the exhaust gases to leave the engine. Exhaust pipe 7 ducts the exhaust gases away from the engine. The means to move plunger piston 11 is spring 32 and actuator 5, which is driven by upper crankshaft 28 and upper connecting rod 30.

Operation of the Preferred Embodiment

The preferred embodiment of this invention employs a two stroke cycle divided into three parts. The first part is the intake and the exhaust part. The second is the compression part, and the third is the expansion part. The expansion part is from about top dead center to about 85% of the downward travel of power piston 18 (or as measured by power output shaft 22 rotation from top dead center to about 135 degrees). The intake and exhaust part is from about 85% of the downward travel of power piston 18 (135°) to about 15% of the travel back up (225°). The compression part is from about 15% of the travel back up of power piston 18 (225°) to about top dead center. The above positions are all estimates and are given for descriptive purposes only. The actual position a part of the cycle may begin or end at, may be different from those set out above.

In the preferred embodiment of this invention plunger piston 11 makes two strokes every three cycles, a stroke towards power piston 18, which is the regenerative cooling stroke (exhaust gases cool); and a stroke away from power piston 18 which is the regenerative heating stroke (working fluid heats).

The regenerative cooling stroke begins with plunger piston 11 adjacent to cylinder head 4, as shown in FIG. 1. Actuator 5 comes in contact with the stem of exhaust valve 6 and urges it open, and urges plunger piston 11 away from cylinder head 4. Spring 32 pushing on exhaust valve 6 forces plunger piston 11 down until it is adjacent to power piston 18. As plunger piston 11 is making the regenerative cooling stroke it is also forcing out exhaust gases and sucking in fresh air. As plunger piston 11 and movable regenerator 10 move away from cylinder head 4, protector valve 26 is urged open by protector valve spring 27 (as shown in FIG. 2). During the regenerative cooling stroke plunger piston 11 moves down (towards power piston 18) forcing the hot exhaust gases through protector valve 26 and movable regenerator 10, and out of the engine through exhaust valve 6. When this happens movable regenerator 10 absorbs heat from the exhaust gases (cooling the exhaust gases). Also during the regenerative cooling stroke plunger piston valve 8 is closed and as plunger piston 11 moves toward power piston 18 the vacuum created causes inlet air valve 2 to open and fresh air to move into the space between power piston 18 and cylinder head 4.

The compression cycle starts with plunger piston 11 close to and moving up with power piston 18 and continues until power piston 18 is at about 315 degrees. The regenerative heating takes place between 315 degrees and 360 degrees position of power piston 18. The pressure difference across exhaust valve 6 forces plunger piston 11 away from power piston 18 and up against cylinder head 4, and cylinder head 4 pushes protector valve 26 closed. During regenerative heating, movable regenerator 10 is moved up through the working fluid trapped between power piston 18 and cylinder head 4 and transfers heat to this working fluid (heating the working fluid).

When plunger piston 11 containing movable regenerator 10, reaches cylinder head 4 and protector valve 26 is closed by cylinder head 4, fuel is injected and combustion and expansion begin. During combustion and expansion, protector 24 protects the regenerator from the heat of combustion. Protector 24 also isolates the expansion process from the volume of movable regenerator 10.

CONCLUSION

Accordingly, the reader will see that the protector meets the following objects and advantages:

(a) The regenerator is protected from the combustion heat.

(b) The regenerator fluid volume does not effect the thermal pressure rise process of the engine.

I claim:

1. A protector for a moveable regenerator in an engine, said regenerator protector is made up of a protective wall, a valve in said protective wall that is closed when the stem of said valve comes in contact with the engine cylinder head and a spring to urge said valve open whenever said regenerator is away from said engine cylinder head.

2. A process for operating said regenerator protector of claim 1 having the following steps:

a) when said regenerator moves away from said engine cylinder head, said spring urges said valve open and exhaust gases are moved through said regenerator;

b) when said regenerator moves up against said engine cylinder head, said cylinder head urges said valve closed and said regenerator is protected.

* * * * *